US011401590B2

(12) United States Patent
Harada et al.

(10) Patent No.: US 11,401,590 B2
(45) **Date of Patent: *Aug. 2, 2022**

(54) SOFT MAGNETIC ALLOY AND MAGNETIC DEVICE

(71) Applicant: TDK CORPORATION, Tokyo (JP)

(72) Inventors: Akihiro Harada, Tokyo (JP); Hiroyuki Matsumoto, Tokyo (JP); Kenji Horino, Tokyo (JP); Kazuhiro Yoshidome, Tokyo (JP); Akito Hasegawa, Tokyo (JP); Hajime Amano, Tokyo (JP); Kensuke Ara, Tokyo (JP); Seigo Tokoro, Tokyo (JP); Masakazu Hosono, Tokyo (JP); Takuma Nakano, Tokyo (JP); Satoko Mori, Tokyo (JP)

(73) Assignee: TDK CORPORATION, Tokyo (JP)

( * ) Notice: Subject to any disclaimer, the term of this patent is extended or adjusted under 35 U.S.C. 154(b) by 51 days.

This patent is subject to a terminal disclaimer.

(21) Appl. No.: 16/643,981

(22) PCT Filed: May 17, 2018

(86) PCT No.: PCT/JP2018/019127

§ 371 (c)(1),
(2) Date: Mar. 3, 2020

(87) PCT Pub. No.: WO2019/053948

PCT Pub. Date: Mar. 21, 2019

(65) Prior Publication Data

US 2021/0062308 A1 Mar. 4, 2021

(30) Foreign Application Priority Data

Sep. 15, 2017 (JP) ..... JP2017-178135

(51) Int. Cl.
*C22C 38/16* (2006.01)
*C22C 38/02* (2006.01)
(Continued)

(52) U.S. Cl.
CPC ..... *C22C 38/16* (2013.01); *B22F 1/00* (2013.01); *B22F 1/07* (2022.01); *B22F 3/00* (2013.01); *C22C 33/0278* (2013.01); *C22C 38/00* (2013.01); *C22C 38/001* (2013.01); *C22C 38/002* (2013.01); *C22C 38/007* (2013.01); *C22C 38/008* (2013.01); *C22C 38/02* (2013.01); *C22C 38/04* (2013.01); *C22C 38/06* (2013.01); *C22C 38/08* (2013.01); *C22C 38/10* (2013.01); *C22C 38/105* (2013.01); *C22C 38/12* (2013.01); *C22C 38/14* (2013.01); *C22C 38/26* (2013.01); *C22C 45/008* (2013.01); *C22C 45/02* (2013.01); *H01F 1/12* (2013.01); *H01F 1/14* (2013.01); *H01F 1/14708* (2013.01); *H01F 1/14716* (2013.01); *H01F 1/14733* (2013.01); *H01F 1/153* (2013.01); *H01F 1/15308* (2013.01); *H01F 1/15325* (2013.01); *H01F 1/15333* (2013.01); *H01F 41/0246* (2013.01);
(Continued)

(58) Field of Classification Search
CPC ..... C22C 2202/02; C22C 38/16; C22C 38/00; C22C 38/002; C22C 38/02; C22C 38/08; C22C 38/10; C22C 38/12; C22C 38/14; C22C 38/06; C22C 38/105; C22C 38/26; C22C 38/007; C22C 38/008; C22C 38/04; C22C 38/001; C22C 45/02; C22C 45/008; C22C 2000/02; C22C 33/0278; H01F 1/153; H01F 1/15308; H01F 1/15333; H01F 1/15325; H01F 1/12; H01F 1/14; H01F 1/14708; H01F 1/14716; H01F 1/14733; H01F 41/0246; B22F 1/00; B22F 3/00; B22F 1/0044; B22F 1/0085; B22F 1/0088; B22F 1/0059; B22F 3/02; B22F 2009/0824; B22F 2009/0828; B22F 2998/10; B22F 2999/00; B22F 1/07; C21D 6/00; Y10T 428/12951; Y10T 428/12465
See application file for complete search history.

(56) References Cited

U.S. PATENT DOCUMENTS 10,847,292 B2 * 11/2020 Yoshidome ..... C22C 38/32
2012/0318412 A1 * 12/2012 Ohta ..... C21D 8/1211 148/548

(Continued)

FOREIGN PATENT DOCUMENTS

CN 102412045 A * 4/2012
JP 03-268306 A * 11/1991

(Continued)

OTHER PUBLICATIONS

Machine Translation, Wang, CN 102412045 A, Apr. 2012. (Year: 2012).*

(Continued)

*Primary Examiner* — Michael E. La Villa
(74) *Attorney, Agent, or Firm* — Oliff PLC

(57) ABSTRACT

Provided is a soft magnetic alloy having a composition of a compositional formula $(Fe_{(1-(\alpha+\beta))}X1_{\alpha}X2_{\beta})_{(1-(a+b+c+d+e))}P_aC_bSi_cCu_dM_e$. X1 is one or more selected from a group consisting of Co and Ni, X2 is one or more selected from a group consisting of Al, Mn, Ag, Zn, Sn, As, Sb, Bi, N, 0, and rare earth elements, and M is one or more selected from the group consisting of Nb, Hf, Zr, Ta, Ti, Mo, W and V. $0.050 \le a \le 0.17$, $0 < b < 0.050$, $0.030 < c \le 0.10$, $0 < d \le 0.020$, $0 \le e \le 0.030$, $\alpha \ge 0$, $\beta \ge 0$, and $0 \le \alpha + \beta \le 0.50$.

11 Claims, No Drawings

(51) Int. Cl.

| | |
|---|---|
| ***C22C 38/00*** | (2006.01) |
| ***C22C 38/14*** | (2006.01) |
| ***C22C 38/12*** | (2006.01) |
| ***C22C 38/10*** | (2006.01) |
| ***C22C 38/08*** | (2006.01) |
| ***H01F 1/153*** | (2006.01) |
| ***C22C 45/02*** | (2006.01) |
| ***B22F 1/00*** | (2022.01) |
| ***B22F 3/00*** | (2021.01) |
| ***C22C 38/06*** | (2006.01) |
| ***C22C 38/04*** | (2006.01) |
| ***H01F 1/147*** | (2006.01) |
| ***H01F 1/12*** | (2006.01) |
| ***C22C 45/00*** | (2006.01) |
| ***H01F 1/14*** | (2006.01) |
| ***C22C 38/26*** | (2006.01) |
| ***C22C 33/02*** | (2006.01) |
| ***H01F 41/02*** | (2006.01) |
| ***B22F 1/07*** | (2022.01) |
| *C21D 6/00* | (2006.01) |
| *B22F 9/08* | (2006.01) |

(52) U.S. Cl.
CPC ..... *B22F 2009/0824* (2013.01); *B22F 2009/0828* (2013.01); *B22F 2998/10* (2013.01); *B22F 2999/00* (2013.01); *C21D 6/00* (2013.01); *C22C 2202/02* (2013.01); *Y10T 428/12465* (2015.01); *Y10T 428/12951* (2015.01)

(56) References Cited

U.S. PATENT DOCUMENTS

| | | | | |
|---|---|---|---|---|
| 2019/0221341 | A1* | 7/2019 | Yoshidome | C22C 38/00 |
| 2019/0221342 | A1* | 7/2019 | Yoshidome | H01F 1/15308 |
| 2019/0237229 | A1* | 8/2019 | Yoshidome | C22C 45/04 |
| 2019/0279796 | A1* | 9/2019 | Hosono | H01F 1/14766 |
| 2019/0279799 | A1* | 9/2019 | Hosono | H01F 27/255 |
| 2019/0355498 | A1* | 11/2019 | Yoshidome | H01F 1/14741 |
| 2020/0135369 | A1* | 4/2020 | Yoshidome | C22C 45/02 |

FOREIGN PATENT DOCUMENTS

| | | | |
|---|---|---|---|
| JP | 2013185162 | A * | 9/2013 |
| JP | 2016-211017 | A | 12/2016 |

OTHER PUBLICATIONS

Machine Translation, Urata, JP 2013-185162, Sep. 2013. (Year: 2013).*
Machine Translation, Fujii Yoko, JP 03-268306 A, Nov. 1991. (Year: 1991).*

* cited by examiner

SOFT MAGNETIC ALLOY AND MAGNETIC DEVICE

BACKGROUND OF THE INVENTION

The invention relates to a soft magnetic alloy and a magnetic device.

Recently, low power consumption and high efficiency are demanded in such as electronic, information, and communication equipment. In addition, the above demands are becoming stronger toward a low carbon society. Therefore, reduction of energy loss or improvement of power supply efficiency are also required for power supply circuits of the electronic, information, and communication equipment, etc. For the magnetic core of the magnetic element to be used in the power supply circuit, an improvement in saturation magnetic flux density, a reduction in core loss (magnetic core loss), and an improvement in magnetic permeability are required. The loss of power energy will be reduced if the core loss is reduced, and the magnetic element can be reduced in size if the saturation magnetic flux density and the magnetic permeability are improved, thereby, the high efficiency and the energy saving can be achieved. As a method for reducing the core loss of the magnetic core, it is conceivable to reduce the coercive force of the magnetic body constituting the magnetic core.

Fe-based soft magnetic alloys are used as soft magnetic alloys included in the magnetic core of the magnetic element. Fe-based soft magnetic alloys are desired to have preferable soft magnetic properties (a high saturation magnetic flux density, a low coercive force and a high magnetic permeability) and corrosion resistance.

Patent Document 1 discloses an Fe based alloy composition in which contents of B, Si, P, Cu, Fe, C and Cr is controlled within a specific range.

BRIEF SUMMARY OF THE INVENTION

Patent Document 1: JP 2016-211017 A

An object of the invention is to provide such as a soft magnetic alloy simultaneously having a high corrosion resistance, a high saturation magnetic flux density, a low coercive force and a high magnetic permeability μ'.

In order to achieve the object, the soft magnetic alloy of the invention has a composition of a compositional formula $(Fe_{(1-(\alpha+\beta))}X1_{\alpha}X2_{\beta})_{(1-(a+b+c+d+e))})P_aC_bSi_cCu_dM_e$, wherein X1 is one or more selected from a group consisting of Co and Ni, X2 is one or more selected from a group consisting of Al, Mn, Ag, Zn, Sn, As, Sb, Bi, N, O, and rare earth elements, M is one or more selected from the group consisting of Nb, Hf, Zr, Ta, Ti, Mo, W and V, $0.050 \le a \le 0.17$, $0 < b < 0.050$, $0.030 < c \le 0.10$, $0 < d \le 0.020$, $0 \le e \le 0.030$, $\alpha \ge 0$, $\beta \ge 0$, and $0 \le \alpha + \beta \le 0.50$.

Since the soft magnetic alloy of the invention has the above properties, it is easy for the soft magnetic alloy to have a structure that can be easily converted into an Fe-based nanocrystalline alloy by heat treatment. Further, the Fe-based nanocrystalline alloy having the above properties has preferred soft magnetic properties such as a high saturation magnetic flux density, a low coercive force and a high magnetic permeability μ', and further, a high corrosion resistance.

The soft magnetic alloy of the invention may satisfy $0 \le \alpha\{1-(a+b+c+d+e)\} \le 0.40$.

The soft magnetic alloy of the invention may satisfy $\alpha=0$

The soft magnetic alloy of the invention may satisfy $0 \le \beta\{1-(a+b+c+d+e)\} \le 0.030$.

The soft magnetic alloy of the invention may satisfy $\beta=0$

The soft magnetic alloy of the invention may satisfy $\alpha=\beta=0$

The soft magnetic alloy of the invention may have a nanohetero structure including an amorphous and an initial fine crystal existing inside the amorphous.

The soft magnetic alloy of the invention may have an average grain size of the initial fine crystal of 0.3 to 10 nm.

The soft magnetic alloy of the invention may have a structure including an Fe-based nanocrystal.

The soft magnetic alloy of the invention may have the average grain size of the Fe-based nanocrystals of 5 to 30 nm.

The soft magnetic alloy of the invention may have a form of a ribbon.

The soft magnetic alloy of the invention may have a form of a powder.

The magnetic device of the invention may be made from the soft magnetic alloy of the invention.

DETAILED DESCRIPTION OF INVENTION

Hereinafter, embodiments of the invention will be described.

The soft magnetic alloy of the embodiment has a composition of a compositional formula $(Fe_{(1-(\alpha+\beta))}X1_{\alpha}X2_{\beta})_{(1-(a+b+c+d+e))})P_aC_bSi_cCu_dM_e$, wherein X1 is one or more selected from a group consisting of Co and Ni, X2 is one or more selected from a group consisting of Al, Mn, Ag, Zn, Sn, As, Sb, Bi, N, O, and rare earth elements, M is one or more selected from the group consisting of Nb, Hf, Zr, Ta, Ti, Mo, W and V, $0.050 \le a \le 0.17$, $0 < b < 0.050$, $0.030 < c \le 0.10$, $0 < d \le 0.020$, $0 \le e \le 0.030$, $\alpha \ge 0$, $\beta \ge 0$, and $0 \le \alpha + \beta \le 0.50$.

The soft magnetic alloy has the above composition, thus, it is easy to make a soft magnetic alloy including amorphous and not containing a crystal phase including crystals having a particle grain larger than 30 nm. And it is easy to precipitate Fe-based nanocrystals when heat-treating the soft magnetic alloy. And soft magnetic alloys including the Fe-based nanocrystals are likely to show good magnetic properties.

In other words, the soft magnetic alloy having the above composition is likely to be a starting material of the soft magnetic alloy precipitating the Fe-based nanocrystals.

The Fe-based nanocrystals have a particle grain of nano-order and a crystal structure of Fe is bcc (body-centered cubic lattice). In the embodiment, it is preferable to precipitate Fe-based nanocrystals having an average grain size of 5 to 30 nm. The soft magnetic alloy in which such Fe-based nanocrystals are precipitated tends to have a high saturation magnetic flux density, a low coercive force, and further, a high permeability μ'. The permeability μ' refers to the real part of the complex magnetic permeability.

Note that, the soft magnetic alloy before being subjected to a heat treatment may be completely composed only of an amorphous phase, but it is preferable that the soft magnetic alloy is composed of an amorphous phase and initial fine crystals having a grain size of 15 nm or less and has a nanohetero structure in which the initial fine crystals are present in the amorphous phase. The Fe-based nanocrystals are likely to be precipitated at the time of the heat treatment as the soft magnetic alloy has a nanohetero structure in which the initial fine crystals are present in the amorphous phase. Note that, in the present embodiment, it is preferable that the initial fine crystals have an average grain size of 0.3 to 10 nm.

Hereinafter, each component of the soft magnetic alloy according to the embodiment will be described in detail.

The P content (a) satisfies $0.050 \leq a \leq 0.17$ and preferably satisfies $0.070 \leq a \leq 0.15$. The coercive force and the permeability μ' can be particularly improved by setting the P content within the above range. In case when the P content (a) is excessively large, the coercive force increases and the magnetic permeability μ' decreases. In case when the P content (a) is excessively small, the soft magnetic alloy before the heat treatment tends to form a crystal phase including crystals having a grain size larger than 30 nm. When this crystal phase is formed, the Fe-based nanocrystals cannot be precipitated by the heat treatment. Thus, the coercive force tends to be high, and the magnetic permeability μ' tends to be low.

The C content (b) satisfies $0<b<0.050$, preferably satisfies $0.005 \leq b \leq 0.045$, and more preferably satisfies $0.010 \leq b \leq 0.040$. The coercive force and the permeability μ' can be particularly improved by setting the C content within the above range. In case when the C content (b) is excessively large, the coercive force increases and the magnetic permeability μ' decreases. In case when the C content (b) is excessively small, the soft magnetic alloy before the heat treatment tends to form a crystal phase including crystals having a grain size larger than 30 nm. When this crystal phase is formed, the Fe-based nanocrystals cannot be precipitated by the heat treatment. Thus, the coercive force tends to be high, and the magnetic permeability μ' tends to be low.

The Si content (c) satisfies $0.030<c \leq 0.10$, and preferably satisfies $0.032 \leq c \leq 0.100$. The corrosion resistance, the saturation magnetic flux density, coercive force and the permeability μ' can be improved by setting the Si content within the above range. In case when the Si content (c) is excessively large, the saturation magnetic flux density decreases. In case when the Si content (c) is excessively small, the corrosion resistance decreases, the coercive force increases, and the magnetic permeability μ' decreases. Furthermore, the Si content (c) more preferably satisfies $0.040 \leq c \leq 0.070$. The coercive force and the permeability μ' can be particularly improved by satisfying $0.040 \leq c \leq 0.070$.

The Cu content (d) satisfies $0<d \leq 0.020$, preferably satisfies $0.005 \leq d \leq 0.020$, and more preferably satisfies $0.010 \leq d \leq 0.015$. The corrosion resistance, coercive force and the permeability μ' can be particularly improved by setting the Cu content within the above range. In case when the Cu content (d) is excessively large, the soft magnetic alloy before the heat treatment tends to form a crystal phase including crystals having a grain size larger than 30 nm. When this crystal phase is formed, the Fe-based nanocrystals cannot be precipitated by the heat treatment. Thus, the coercive force tends to be high, and the magnetic permeability μ' tends to be low. In case when the Cu content (d) is excessively small, the corrosion resistance decreases, the coercive force increases, and the magnetic permeability μ' decreases.

M is one or more selected from a group consisting of Nb, Hf, Zr, Ta, Ti, Mo, W and V.

The M content (e) satisfies $0 \leq e \leq 0.030$. That is, it is not necessary to include M. As the M content (e) increases, the coercive force tends to decrease and the permeability μ' tends to increase, but the saturation magnetic flux density tends to decrease.

The Fe content $(1-(a+b+c+d+e))$ is not particularly limited, but preferably satisfies $0.675 \leq (1-(a+b+c+d+e)) \leq 0.885$. By setting $(1-(a+b+c+d+e))$ within the above range, a crystalline phase including crystals having a grain size larger than 30 nm is further hardly generated in the soft magnetic alloy before the heat treatment.

The soft magnetic alloy according to the embodiment, a part of Fe may be substituted with X1 and/or X2.

X1 is one or more selected from a group consisting of Co and Ni. Regarding the X1 content, it may be $\alpha=0$. That is, X1 may not be included. Further, the number of atoms of X1 is preferably 40 at % or less, with respect to 100 at % of the total number of atoms of the entire composition. That is, it is preferable to satisfy $0 \leq \alpha\{1-(a+b+c+d+e)\} \leq 0.40$.

X2 is one or more selected from a group consisting of Al, Mn, Ag, Zn, Sn, As, Sb, Bi, N, O and rare earth elements. Regarding the X2 content, it may be $\beta=0$. That is, X2 may not be included. Further, the number of atoms of X2 is preferably 3.0 at % or less, with respect to 100 at % of the total number of atoms of the entire composition. That is, it is preferable to satisfy $0 \leq \beta\{1-(a+b+c+d+e)\} \leq 0.030$.

A range of the substitution amount, substituting Fe with X1 and/or X2, is a half or less of Fe based on the number of the atomic. That is, $0 \leq \alpha+\beta \leq 0.50$ is satisfied. When $\alpha+\beta>0.50$, it becomes difficult to form the Fe-based nanocrystalline alloy by the heat treatment.

It should be noted that the soft magnetic alloy according to the embodiment may include elements other than the above (for example, B, Cr, etc.) as inevitable impurities. For example, it may be included in an amount of 0.1 wt % or less with respect to 100 wt % of the soft magnetic alloy. B is relatively expensive, and Cr tends to lower the soft magnetic properties, so it is preferable to reduce the contents of B and Cr.

Hereinafter, a producing method of the soft magnetic alloy according to the embodiment will be described.

The producing method of the soft magnetic alloy according to the embodiment is not particularly limited. For example, there is a method of producing a ribbon of the soft magnetic alloy according to the embodiment by a single roll method. The ribbon may be a continuous ribbon.

In the single roll method, first, pure metals of respective metal elements included in the finally obtained soft magnetic alloy are prepared. And weighed thereof to have the same composition as the finally obtained soft magnetic alloy. Then, the pure metals of each metal element are melted and mixed thereof, and a mother alloy is produced. The method for melting the pure metals is not particularly limited, and it may be a method in which the pure metals are melted by heating with a high-frequency after evacuating in a chamber. The mother alloy and the soft magnetic alloy including the finally obtained Fe-based nanocrystal usually have the same composition.

Next, a molten metal is obtained by heating and melting the produced mother alloy. The temperature of the molten metal is not particularly limited, but for example, it may be set to 1200 to 1500° C.

In the single roll method, it is possible to adjust the thickness of the ribbon obtained by mainly adjusting the rotational speed of roll 33. However, for example, it is possible to adjust the thickness of the obtained ribbon by adjusting a gap between nozzle and roll, the temperature of the molten metal, etc. Thickness of the ribbon is not particularly limited, but it may be 5 to 30 μm.

At the time before the latter-mentioned heat treatment, the ribbon is amorphous not having crystals having a grain size of more than 30 nm. The Fe-based nanocrystalline alloy can be obtained by subjecting the amorphous ribbon to the latter-mentioned heat treatment.

Note that a method of confirming the presence of the large crystals having the grain size of more than 30 nm in the ribbon of the soft magnetic alloy before the heat treatment is not particularly limited. For example, the presence of crystals having the grain size of more than 30 nm can be confirmed by an ordinary X-ray diffraction measurement.

Ribbon before the heat treatment may not include any initial fine crystal having the grain size of 15 nm or less, but preferably includes initial fine crystals. That is, it is preferable that the ribbon before the heat treatment has a nanohetero structure including the amorphous and the initial fine crystals present in the amorphous. The grain size of the initial fine crystal is not particularly limited, but the average grain size is preferably in the range of 0.3 to 10 nm.

A method for observing the presence of the initial fine crystals and the average grain size thereof is not particularly limited. This may be confirmed by obtaining a limited-field diffraction image, a nanobeam diffraction image, a bright field image, or a high resolution image of a sample that has been thinned by an ion milling using a transmission electron microscope. When using the limited-field diffraction image or the nanobeam diffraction image, a ring-shaped diffraction pattern is formed when the diffraction pattern is amorphous, whereas diffraction spots due to the crystal structure are formed when the diffraction pattern is not amorphous. When a bright field image or a high resolution image is used, the presence of initial fine crystals and the average grain size can be observed by visual observation at a magnification of $1.00\times10^5$ to $3.00\times10^5$ times.

Temperature and the rotational speed of the roll and an interior atmosphere of the chamber are not particularly limited. The roll temperature is preferably 4 to 30° C. for making amorphous. The higher the rotational speed of the roll, the smaller the average grain size of the initial fine crystals tends to be. The rotational speed is preferably 30 to 40 msec. to obtain the initial fine crystals having an average grain size of 0.3 to 10 nm. The atmosphere inside the chamber is preferably air, when considering the cost.

Furthermore, the heat treatment conditions for producing the Fe-based nanocrystalline alloys are not particularly limited. Preferred heat treatment conditions vary depending on the composition of the soft magnetic alloy. Usually, the preferred heat treatment temperature is approximately 380 to 500° C., and the preferred heat treatment time is approximately 5 to 120 minutes. However, depending on the composition, there may be a preferred heat treatment temperature and heat treatment time outside the above range. Moreover, the atmosphere during the heat treatment is not particularly limited. It may be performed under an active atmosphere such as air or may be performed under an inert atmosphere such as Ar gas.

Further, the method of calculating the average grain size of the Fe-based nanocrystalline alloy obtained is not particularly limited. For example, it can be calculated by observing using a transmission electron microscope. The method for confirming that the crystal structure is bcc (body-centered cubic lattice structure) is also not particularly limited. For example, it can be confirmed using the X-ray diffraction measurement.

Further, as a method for obtaining a soft magnetic alloy according to the embodiment, a water atomization method or a gas atomization method is exemplified in addition to the single roll method as described above, as a method of obtaining a powdered soft magnetic alloy according to the embodiment. Hereinafter, the gas atomization method will be described.

In the gas atomizing method, a molten alloy of 1200 to 1500° C. is obtained in the same manner as the above single roll method. Thereafter, the molten alloy is injected in the chamber to prepare a powder.

During the time, the above preferable nanohetero structure is easier to obtain by setting the gas injection temperature to 4 to 30° C. and the vapor pressure in the chamber to 1 hPa or less.

Heat treatment may be carried out at 400 to 600° C. for 0.5 to 10 minutes after preparing the powder by the gas atomizing method. By performing the heat treatment, while preventing sintering of each powder and making coarse elements, the diffusion of elements can be promoted, the thermodynamic equilibrium state can be reached in a short time, strain and stress can be removed, and an Fe-based soft magnetic alloy having an average grain size of 10 to 50 nm can be easily obtained.

Although one embodiment of the invention has been described above, the invention is not limited to the above embodiment.

The shape of the soft magnetic alloy according to the embodiment is not particularly limited. As described above, a ribbon shape or a powdery shape is exemplified, and in addition, a block shape, etc. are also conceivable.

The application of the soft magnetic alloy, the Fe-based nanocrystalline alloy, according to the embodiment is not particularly limited. The magnetic device can be exemplified, and among them, the magnetic core is particularly exemplified. The soft magnetic alloy of the embodiment can be suitably used as a magnetic core for an inductor, particularly for a power inductor. In addition to the magnetic core, the soft magnetic alloy of the embodiment can also be suitably used for such as a thin film inductor and a magnetic head.

Hereinafter, a method of obtaining the magnetic device, particularly the magnetic core and the inductor, from the soft magnetic alloy according to the embodiment will be described, but the method of obtaining the magnetic core and the inductor from the soft magnetic alloy according to the embodiment is not limited to the following method. The applications of the magnetic core include transformers, motors, etc. in addition to inductors.

As a method for obtaining a magnetic core from a ribbon shaped soft magnetic alloy, for example, a method of winding the ribbon shaped soft magnetic alloy or a method of laminating the same can be mentioned. In case of laminating the ribbon shaped soft magnetic alloys via an insulator at the time of lamination, it is possible to obtain a magnetic core with further improved properties.

As a method for obtaining the magnetic core from the soft magnetic alloy of a powdery state, a pressing method using a press mold after appropriately mixing with a binder is exemplified. Also, by subjecting an oxidation treatment, an insulating coating, etc. to the powder surface before mixing with the binder, specific resistance improves, and it becomes a magnetic core suitable for a higher frequency band.

The pressing method is not particularly limited, and a pressing using a press mold, a mold pressing, etc. are exemplified. A kind of binder is not particularly limited, and silicone resins are exemplified. A mixing ratio of the soft magnetic alloy powder and binder is not particularly limited. For example, 1 to 10 mass % of binder is mixed with 100 mass % of the soft magnetic alloy powder.

For example, by mixing 1 to 5 mass % of binder with 100 mass % of the soft magnetic alloy powder and performing compression molding using the press mold, a magnetic core having a space factor (powder filling rate) of 70% or more, magnetic flux density of 0.45 T or more when a magnetic field of $1.6\times10^4$ A/m is applied and specific resistance of 1 Ω·cm or more can be obtained. The above properties are equivalent to or superior to the general ferrite magnetic cores.

Further, for example, by mixing 1 to 3 mass % of binder with 100 mass % of the soft magnetic alloy powder and performing compression molding using the press mold under a temperature condition not lower than the softening point of the binder, a dust core having a space factor of 80% or more, magnetic flux density of 0.9 T or more when a magnetic field of $1.6\times10^4$ A/m is applied and specific resistance of 0.1 Ω·cm or more can be obtained. The above properties are superior to general dust cores.

Furthermore, by subjecting a green compact forming the above magnetic core to heat treatment after pressing as strain relieving heat treatment, the core loss further decreases, and the usefulness is enhanced. Note that the core loss of the magnetic core is reduced by reducing the coercive force of the magnetic body constituting the magnetic core.

Inductance components can be obtained by applying wire on the above magnetic core. Methods to prepare the wire and to prepare inductance components are not particularly limited. For example, a method of winding the wire around the magnetic core prepared by the above method for at least one turn can be exemplified.

In case when the soft magnetic alloy particles are used, there is a method of preparing inductance components by pressing and integrating a state in which a winding coil is stored in a magnetic material. In this case, it is easy to obtain an inductance component corresponding to a high frequency and a large current.

Furthermore, in the case of using soft magnetic alloy particles, a soft magnetic alloy paste, in which binder and solvent are added to the soft magnetic alloy particles and pasted thereof, and a conductive paste, in which binder and solvent are added to the conductor metal for the coil and pasted thereof, are alternatively printed and laminated. Then heated and fired thereof, and an inductance component can be obtained. Alternatively, a soft magnetic alloy sheet is prepared by using a soft magnetic alloy paste and a conductor paste is printed on the surface of the soft magnetic alloy sheet. Then laminated and fired thereof, whereby an inductance component in which a coil is stored in a magnetic body can be obtained.

In case of preparing an inductance component using soft magnetic alloy particles, it is preferable to use the soft magnetic alloy powder having a maximum grain size of 45 μm or less in terms of sieve size and a center grain size (D50) of 30 μm or less, to obtain superior Q properties. To make the maximum grain size 45 μm or less in terms of sieve size, a sieve with a mesh size of 45 μm may be used, and only the soft magnetic alloy powder passing through the sieve may be used.

As the soft magnetic alloy powder having a large maximum grain size is used, the Q value in a high frequency area tends to decrease. Particularly, in case of using the soft magnetic alloy powder having a maximum grain size exceeding 45 μm in terms of sieve size, Q value may decrease greatly in high frequency area. However, when Q value in high frequency area is not valued, it is possible to use a soft magnetic alloy powder having large variations. Since soft magnetic alloy powder having large variations can be produced with a relatively low cost, it is possible to reduce the cost when soft magnetic alloy powder with large variation is used.

EXAMPLE

Hereinafter, the invention will be specifically described based on examples.

Raw metal was weighed to have the alloy compositions of the examples and comparative examples shown in the table below. Then, the weighed raw metals were melted by high frequency heating and prepared the mother alloy.

Thereafter, the produced mother alloy was heated and melted to form a molten metal of 1300° C., and then the molten metal was jetted onto a roll by the single roll method using a roll of 20° C. in an atmosphere at a rotational speed of 40 msec. and produced the ribbon. The thickness of the ribbon was 20 to 25 μm, the width thereof was approximately 15 mm, and the length thereof was approximately 10 m.

The obtained each ribbon was subjected to an X-ray diffraction measurement. The presence of large crystals having a grain size of more than 30 nm was confirmed. It was assumed to include an amorphous phase when there is no crystal having a grain size of more than 30 nm, while it was assumed to include a crystalline phase when there are crystals having a grain size of more than 30 nm. The amorphous phase may include the initial fine crystal having the grain size of 15 nm or less.

Then, with respect to the ribbon of Examples and Comparative Examples, it was subjected to a heat treatment for 10 minutes at the temperature shown in the table below. In addition, the heat treatment temperature of samples which do not have the description of the heat treatment temperature in the below table was 450° C. The saturation magnetic flux density, the coercive force, and the magnetic permeability of each ribbon after the heat treatment were measured. Saturation magnetic flux density (Bs) was measured at a magnetic field of 1000 kA/m using a vibrating sample magnetometer (VSM). The coercive force (Hc) was measured at a magnetic field of 5 kA/m using a direct current BH tracer. The magnetic permeability (μ') was measured at a frequency of 1 kHz using an impedance analyzer. According to the embodiment, the saturation magnetic flux density of 1.40 T or more was considered preferable. The coercive force of 15.0 A/m or less was considered preferable, and 10.0 A/m or less was considered more preferable. The magnetic permeability μ' was considered preferable at 15,000 or more, and more preferable at 20,000 or more.

In addition, the ribbons of each example and the comparative example were subjected to a constant temperature and a constant humidity test to evaluate the corrosion resistance thereof. It was observed how many hours no corrosion occurs under the conditions of a temperature at 80° C. and a humidity of 85% RH. In this example, 7 hours or longer was considered preferable.

In the examples shown below, it was confirmed by observation using an X-ray diffraction measurement and a transmission electron microscope that all the ribbons included the Fe-based nanocrystals having an average grain size of 5 to 30 nm and a crystal structure of bcc, unless otherwise specified.

TABLE 1

| | Fe (1 − (a + b + c + d)) PaCbSicCud (e = O) | | | | | | | | | |
|---|---|---|---|---|---|---|---|---|---|---|
| Sample No. | Fe | P a | C b | Si c | Cu d | XRD | Constant temperature and Constant humidity Test 80° C. × 85 RH/h (h) | Bs (T) | Hc (A/m) | μ' (1 kHz) |
| Comp. Ex. 1 | 0.830 | 0.140 | 0.030 | 0.000 | 0.000 | Amorphous phase | 3 | 1.71 | 32.3 | 7500 |
| Comp. Ex. 2 | 0.820 | 0.140 | 0.030 | 0.000 | 0.010 | Amorphous phase | 3 | 1.68 | 20.8 | 12200 |
| Comp. Ex. 3 | 0.790 | 0.140 | 0.030 | 0.040 | 0.000 | Amorphous phase | 5 | 1.62 | 21.2 | 11400 |
| Ex. 1 | 0.780 | 0.140 | 0.030 | 0.040 | 0.010 | Amorphous phase | 15 | 1.61 | 6.2 | 24400 |

TABLE 2

| | Fe (1 − (a + b + c + d)) PaCbSicCud (e = O) | | | | | | | | | |
|---|---|---|---|---|---|---|---|---|---|---|
| Sample No. | Fe | P a | C b | Si c | Cu d | XRD | Constant temperature and Constant humidity Test 80° C. × 85 RH/h (h) | Bs (T) | Hc (A/m) | μ' (1 kHz) |
| Comp. Ex. 2 | 0.730 | 0.180 | 0.030 | 0.050 | 0.010 | Amorphous phase | 19 | 1.50 | 24.3 | 10700 |
| Ex. 2 | 0.740 | 0.170 | 0.030 | 0.050 | 0.010 | Amorphous phase | 17 | 1.53 | 12.6 | 18300 |
| Ex. 3 | 0.760 | 0.150 | 0.030 | 0.050 | 0.010 | Amorphous phase | 17 | 1.57 | 5.8 | 24800 |
| Ex. 4 | 0.780 | 0.130 | 0.030 | 0.050 | 0.010 | Amorphous phase | 16 | 1.60 | 6.1 | 24400 |
| Ex. 5 | 0.810 | 0.100 | 0.030 | 0.050 | 0.010 | Amorphous phase | 15 | 1.67 | 6.5 | 24100 |
| Ex. 6 | 0.840 | 0.070 | 0.030 | 0.050 | 0.010 | Amorphous phase | 13 | 1.75 | 7.0 | 22900 |
| Ex. 7 | 0.860 | 0.050 | 0.030 | 0.050 | 0.010 | Amorphous phase | 13 | 1.79 | 13.1 | 18300 |
| Comp. Ex. 3 | 0.870 | 0.040 | 0.030 | 0.050 | 0.010 | Crystalline phase | 12 | 1.81 | 257 | 3700 |

TABLE 3

| | Fe (1 − (a + b + c + d)) PaCbSicCud (e = O) | | | | | | | | | |
|---|---|---|---|---|---|---|---|---|---|---|
| Sample No. | Fe | P a | C b | Si c | Cu d | XRD | Constant temperature and Constant humidity Test 80° C. × 85 RH/h (h) | Bs (T) | Hc (A/m) | μ' (1 kHz) |
| Comp. Ex. 4 | 0.790 | 0.100 | 0.050 | 0.050 | 0.010 | Amorphous phase | 14 | 1.61 | 15.5 | 14700 |
| Ex. 8 | 0.795 | 0.100 | 0.045 | 0.050 | 0.010 | Amorphous phase | 15 | 1.62 | 11.7 | 19000 |
| Ex. 9 | 0.800 | 0.100 | 0.040 | 0.050 | 0.010 | Amorphous phase | 14 | 1.64 | 6.3 | 24200 |
| Ex. 5 | 0.810 | 0.100 | 0.030 | 0.050 | 0.010 | Amorphous phase | 15 | 1.67 | 6.5 | 24100 |
| Ex. 10 | 0.830 | 0.100 | 0.010 | 0.050 | 0.010 | Amorphous phase | 14 | 1.71 | 6.9 | 23200 |
| Ex. 11 | 0.835 | 0.100 | 0.005 | 0.050 | 0.010 | Amorphous phase | 14 | 1.72 | 13.1 | 18500 |
| Comp. Ex. 5 | 0.840 | 0.100 | 0.000 | 0.050 | 0.010 | Crystalline phase | 12 | 1.74 | 239 | 5900 |

TABLE 4

| | Fe (1 − (a + b + c + d)) PaCbSicCud (e = O) | | | | | | | | | |
|---|---|---|---|---|---|---|---|---|---|---|
| Sample No. | Fe | P a | C b | Si c | Cu d | XRD | Constant temperature and Constant humidity Test 80° C. × 85 RH/h (h) | Bs (T) | Hc (A/m) | μ' (1 kHz) |
| Comp. Ex. 6 | 0.750 | 0.100 | 0.030 | 0.110 | 0.010 | Amorphous phase | 15 | 1.38 | 13.1 | 18200 |
| Ex. 12 | 0.760 | 0.100 | 0.030 | 0.100 | 0.010 | Amorphous phase | 16 | 1.56 | 11.0 | 19400 |
| Ex. 13 | 0.790 | 0.100 | 0.030 | 0.070 | 0.010 | Amorphous phase | 16 | 1.63 | 7.2 | 22700 |
| Ex. 5 | 0.810 | 0.100 | 0.030 | 0.050 | 0.010 | Amorphous phase | 15 | 1.67 | 6.5 | 24100 |
| Ex. 14 | 0.820 | 0.100 | 0.030 | 0.040 | 0.010 | Amorphous phase | 14 | 1.70 | 6.6 | 23600 |
| Ex. 15 | 0.828 | 0.100 | 0.030 | 0.032 | 0.010 | Amorphous phase | 13 | 1.73 | 10.7 | 19900 |
| Comp. Ex. 7 | 0.830 | 0.100 | 0.030 | 0.030 | 0.010 | Amorphous phase | 8 | 1.73 | 18.5 | 13300 |

TABLE 5

| | Fe (1 − (a + b + c + d)) PaCbSicCud (e = O) | | | | | | | | | |
|---|---|---|---|---|---|---|---|---|---|---|
| Sample No. | Fe | P a | C b | Si c | Cu d | XRD | Constant temperature and Constant humidity Test 80° C. × 85 RH/h (h) | Bs (T) | Hc (A/m) | μ' (1 kHz) |
| Comp. Ex. 8 | 0.798 | 0.100 | 0.030 | 0.050 | 0.022 | Crystalline phase | 12 | 1.62 | 312 | 2100 |
| Ex. 16 | 0.800 | 0.100 | 0.030 | 0.050 | 0.020 | Amorphous phase | 15 | 1.64 | 13.2 | 17700 |
| Ex. 17 | 0.805 | 0.100 | 0.030 | 0.050 | 0.015 | Amorphous phase | 15 | 1.66 | 8.8 | 21900 |
| Ex. 5 | 0.810 | 0.100 | 0.030 | 0.050 | 0.010 | Amorphous phase | 15 | 1.67 | 6.5 | 24100 |
| Ex. 18 | 0.815 | 0.100 | 0.030 | 0.050 | 0.005 | Amorphous phase | 13 | 1.69 | 6.7 | 23500 |
| Comp. Ex. 9 | 0.820 | 0.100 | 0.030 | 0.050 | 0.000 | Amorphous phase | 5 | 1.69 | 20.0 | 11700 |

TABLE 6

| | Fe (1 − (a + b + c + d)) PaCbSicCud (e = O) | | | | | | | | | |
|---|---|---|---|---|---|---|---|---|---|---|
| Sample No. | Fe | P a | C b | Si c | Cu d | XRD | Constant temperature and Constant humidity Test 80° C. × 85 RH/h (h) | Bs (T) | Hc (A/m) | μ' (1 kHz) |
| Ex. 19 | 0.885 | 0.060 | 0.010 | 0.040 | 0.005 | Amorphous phase | 12 | 1.82 | 14.6 | 17100 |
| Ex. 5 | 0.810 | 0.100 | 0.030 | 0.050 | 0.010 | Amorphous phase | 15 | 1.67 | 6.5 | 24100 |
| Ex. 20 | 0.675 | 0.170 | 0.040 | 0.100 | 0.015 | Amorphous phase | 18 | 1.41 | 12.8 | 18600 |

TABLE 7

| Sample No. | M Kind | M e | XRD | Constant temperature and Constant humidity Test 80° C. × 85 RH/h (h) | Bs (T) | Hc (A/m) | μ' (1 kHz) |
|---|---|---|---|---|---|---|---|
| | Fe (1 − (a + b + c + d + e)) PaCbSicCudMe (a to d are the same as in Ex. 5) | | | | | | |
| Ex. 5 | — | 0.000 | Amorphous phase | 15 | 1.67 | 6.5 | 24100 |
| Ex. 21 | Nb | 0.010 | Amorphous phase | 15 | 1.57 | 5.7 | 24700 |
| Ex. 22 | Nb | 0.030 | Amorphous phase | 16 | 1.40 | 4.4 | 25200 |
| Comp. Ex. 10 | Nb | 0.050 | Amorphous phase | 17 | 1.22 | 3.2 | 26100 |
| Ex. 23 | Hf | 0.010 | Amorphous phase | 15 | 1.57 | 5.5 | 24800 |
| Ex. 24 | Zr | 0.010 | Amorphous phase | 16 | 1.58 | 5.4 | 24900 |

TABLE 7-continued

| Sample No. | M Kind | M e | XRD | Constant temperature and Constant humidity Test 80° C. × 85 RH/h (h) | Bs (T) | Hc (A/m) | μ' (1 kHz) |
|---|---|---|---|---|---|---|---|
| | Fe (1 − (a + b + c + d + e)) PaCbSicCudMe (a to d are the same as in Ex. 5) | | | | | | |
| Ex. 25 | Ta | 0.010 | Amorphous phase | 15 | 1.56 | 5.3 | 24900 |
| Ex. 26 | Ti | 0.010 | Amorphous phase | 15 | 1.55 | 6.0 | 24400 |
| Ex. 27 | Mo | 0.010 | Amorphous phase | 14 | 1.57 | 5.7 | 24600 |
| Ex. 28 | W | 0.010 | Amorphous phase | 14 | 1.56 | 5.9 | 24400 |
| Ex. 29 | V | 0.010 | Amorphous phase | 15 | 1.55 | 6.0 | 24300 |

TABLE 8

| Sample No. | X1 Kind | X1 α {1 − (a + b + c + d + e)} | X2 Kind | X2 β {1 − (a + b + c + d + e)} | XRD | Constant temperature and Constant humidity Test 80° C. × 85 RH/h (h) | Bs (T) | Hc (A/m) | μ' (1 kHz) |
|---|---|---|---|---|---|---|---|---|---|
| | Fe (1 − (α + β)) X αX2β (a to e are the same as in Ex. 5) | | | | | | | | |
| Ex. 5 | — | 0.000 | — | 0.000 | Amorphous phase | 15 | 1.67 | 6.5 | 24100 |
| Ex. 30 | Co | 0.010 | — | 0.000 | Amorphous phase | 15 | 1.69 | 6.5 | 24000 |
| Ex. 31 | Co | 0.100 | — | 0.000 | Amorphous phase | 15 | 1.72 | 6.7 | 23900 |
| Ex. 32 | Co | 0.400 | — | 0.000 | Amorphous phase | 13 | 1.76 | 7.7 | 23500 |
| Ex. 33 | Ni | 0.010 | — | 0.000 | Amorphous phase | 15 | 1.65 | 6.2 | 24200 |
| Ex. 34 | Ni | 0.100 | — | 0.000 | Amorphous phase | 16 | 1.61 | 5.9 | 24300 |
| Ex. 35 | Ni | 0.400 | — | 0.000 | Amorphous phase | 16 | 1.53 | 5.3 | 24600 |
| Ex. 36 | — | 0.000 | Al | 0.030 | Amorphous phase | 15 | 1.68 | 6.5 | 24100 |
| Ex. 37 | — | 0.000 | Mn | 0.030 | Amorphous phase | 14 | 1.67 | 6.4 | 24100 |
| Ex. 38 | — | 0.000 | Zn | 0.030 | Amorphous phase | 15 | 1.66 | 6.3 | 24200 |
| Ex. 39 | — | 0.000 | Sn | 0.030 | Amorphous phase | 16 | 1.66 | 6.3 | 24300 |
| Ex. 40 | — | 0.000 | Bi | 0.030 | Amorphous phase | 15 | 1.62 | 6.7 | 23900 |
| Ex. 41 | — | 0.000 | Y | 0.030 | Amorphous phase | 14 | 1.65 | 6.6 | 24000 |
| Ex. 42 | Co | 0.100 | Al | 0.030 | Amorphous phase | 14 | 1.68 | 6.5 | 23900 |

TABLE 9

| Sample No. | Rotational speed of the Roll (m/sec) | Heat treatment temperature (° C.) | Average grain diameter of initial microcrystals (nm) | Average grain diameter of Fe-based nano-crystalline alloy (nm) | XRD | Constant temperature and Constant humidity Test 80° C. × 85 RH/h (h) | Bs (T) | Hc (A/m) | μ' (1 kHz) |
|---|---|---|---|---|---|---|---|---|---|
| | a to e are the same as in Ex. 5 | | | | | | | | |
| Ex. 43 | 55 | 400 | No initial microcrystal | 3 | Amorphous phase | 14 | 1.61 | 7.1 | 23700 |
| Ex. 44 | 50 | 380 | 0.1 | 3 | Amorphous phase | 14 | 1.61 | 7.0 | 23600 |
| Ex. 45 | 40 | 400 | 0.3 | 5 | Amorphous phase | 15 | 1.63 | 6.5 | 24200 |
| Ex. 46 | 40 | 425 | 0.3 | 10 | Amorphous phase | 16 | 1.65 | 6.4 | 24100 |
| Ex. 5 | 40 | 450 | 0.3 | 15 | Amorphous phase | 15 | 1.67 | 6.5 | 24100 |
| Ex. 47 | 30 | 450 | 10.0 | 20 | Amorphous phase | 15 | 1.67 | 6.2 | 24400 |

TABLE 9-continued

| | a to e are the same as in Ex. 5 | | | | | | | | |
|---|---|---|---|---|---|---|---|---|---|
| Sample No. | Rotational speed of the Roll (m/sec) | Heat treatment temperature (° C.) | Average grain diameter of initial microcrystals (nm) | Average grain diameter of Fe-based nano-crystalline alloy (nm) | XRD | Constant temperature and Constant humidity Test 80° C. × 85 RH/h (h) | Bs (T) | Hc (A/m) | μ' (1 kHz) |
| Ex. 48 | 30 | 475 | 10.0 | 30 | Amorphous phase | 15 | 1.68 | 6.6 | 24000 |
| Ex. 49 | 20 | 500 | 15.0 | 50 | Amorphous phase | 14 | 1.69 | 7.3 | 23400 |

Table 1 describes Comparative Examples 1 to 3, not including Si and/or Cu, and Example 1.

Example 1, in which the content of each component was within a predetermined range, showed preferable corrosion resistance, saturation magnetic flux density, coercive force and magnetic permeability μ'. On the other hand, according to Comparative Examples 1 to 3 not including Si and/or Cu, the corrosion resistance lowered, the coercive force increased, and the permeability μ' lowered.

Table 2 describes Examples and Comparative Examples all having the same conditions only except the content of P was varied.

Examples 2 to 7, wherein the P content (a) is $0.050 \leq a \leq 0.17$, showed preferable corrosion resistance, saturation magnetic flux density, coercive force and permeability μ'. On the other hand, according to Comparative Example 2 wherein a=0.180, the coercive force increased and the magnetic permeability μ' decreased. According to Comparative Example 3 wherein a=0.040 and the ribbon before the heat treatment includes a crystalline phase, the coercive force remarkably increased and magnetic permeability μ' remarkably reduced after the heat treatment.

Table 3 describes Examples and Comparative Examples wherein the C content (b) was varied.

Examples 8 to 11 satisfying $0<b<0.050$ showed preferable corrosion resistance, saturation magnetic flux density, coercive force and the magnetic permeability μ'. On the other hand, according to Comparative Example 4 wherein b=0.050, the coercive force increased and the magnetic permeability μ' decreased. According to Comparative Example 5 wherein b=0.000 and the ribbon includes a crystalline phase, the coercive force remarkably increased and the permeability μ' remarkably reduced after the heat treatment.

Table 4 describes Examples and Comparative Examples wherein the contents of Si (c) were varied.

Examples 12 to 15 satisfying $0.030<c\leq 0.10$ showed preferable corrosion resistance, saturation magnetic flux density, coercive force and the magnetic permeability μ'. On the other hand, according to Comparative Example 6 wherein c=0.110, the saturation magnetic flux density decreased. According to Comparative Example 5 wherein c=0.030, the corrosion resistance decreased, the coercive force increased, and the magnetic permeability μ' decreased.

Table 5 describes Examples and Comparative Examples wherein the Cu content (d) was varied.

Examples 16 to 18 satisfying $0<d\leq 0.020$ showed preferable corrosion resistance, saturation magnetic flux density, coercive force and the magnetic permeability μ'. On the other hand, according to Comparative Example 8 wherein d=0.022 and the ribbon before the heat treatment includes a crystalline phase, the coercive force rapidly increased and the magnetic permeability μ' rapidly decreased after the heat treatment. According to Comparative Example 9 wherein d=0.000, the corrosion resistance decreased, the coercive force increased, and the magnetic permeability μ' decreased.

Table 6 describes Examples 19 and 20 wherein the Fe content was varied by varying the contents of P, C, Si and Cu within a predetermined range.

All the examples showed preferable corrosion resistance, saturation magnetic flux density, coercive force, and magnetic permeability μ'

Table 7 describes Examples 21 to 29 wherein the M content (e) and the kind of M were varied.

All the examples showed preferable corrosion resistance, saturation magnetic flux density, coercive force, and magnetic permeability μ'. On the other hand, according to Comparative Example 10 wherein the M content (e) is excessively large, the saturation magnetic flux density lowered.

Table 8 describes Examples wherein Fe in Example 5 was partly substituted by X1 and/or X2.

The Examples in Table 8 showed preferable properties even when Fe in Example 5 was partly substituted by X1 and/or X2.

Table 9 shows Examples in which the average grain sizes of the initial fine crystals and the same of the Fe-based nanocrystalline alloy were varied by varying the rotational speed and/or the heat treatment temperature of the roll of Example 5.

The Examples in Table 9 showed preferable properties even when the average grain sizes of the initial fine crystals and the same of the Fe-based nanocrystalline alloy were varied by varying the rotational speed and/or the heat treatment temperature of the roll.

The invention claimed is:

1. A soft magnetic alloy consisting of alloying elements having a compositional formula of $(Fe_{(1-\alpha)}X1_{\alpha})_{(1-(a+b+c+d+e))}P_aC_bSi_cCu_dM_e$, and one or more elements other than those of the alloying elements as an inevitable impurity, wherein X1 is one or more selected from a group consisting of Co and Ni, M is one or more selected from the group consisting of Nb, Hf, Zr, Ta, Ti, Mo, W and V, $0.050\leq a\leq 0.17$, $0.005\leq b\leq 0.045$, $0.032\leq c\leq 0.100$, $0<d\leq 0.020$, $0\leq e\leq 0.030$, and $0\leq \alpha\leq 0.50$, and a content of any element other than those of the alloying elements is 0.1 wt % or less, including 0%, with respect to 100 wt % of the soft magnetic alloy.

2. The soft magnetic alloy according to claim 1, wherein $0 \leq \alpha\{1-(a+b+c+d+e)\} \leq 0.40$.

3. The soft magnetic alloy according to claim 1, wherein $\alpha=0$.

4. The soft magnetic alloy according to claim 1, having a nanohetero structure comprising an amorphous and an initial fine crystal existing inside the amorphous.

5. The soft magnetic alloy according to claim 4, wherein an average grain size of the initial fine crystal is 0.3 to 10 nm.

6. The soft magnetic alloy according to claim 1, having a structure comprising an Fe-based nanocrystal.

7. The soft magnetic alloy according to claim 6, wherein the average grain size of the Fe-based nanocrystals is 5 to 30 nm.

8. The soft magnetic alloy according to claim 1, having a form of a ribbon.

9. The soft magnetic alloy according to claim 1, having a form of powder.

10. A magnetic device comprising the soft magnetic alloy according to claim 1.

11. The soft magnetic alloy according to claim 1, wherein $e=0$.

* * * * *